US007325316B2

(12) United States Patent
Milesi

(10) Patent No.: US 7,325,316 B2
(45) Date of Patent: Feb. 5, 2008

(54) DEVICE AND METHOD FOR INSERTING ELEMENTS INTO THE GROUND, MECHANISM FOR THIS DEVICE AND SYSTEM USING THIS DEVICE

(75) Inventor: Nicolas Milesi, Paris (FR)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 11/703,340

(22) Filed: Feb. 7, 2007

(65) Prior Publication Data

US 2007/0251107 A1 Nov. 1, 2007

(30) Foreign Application Priority Data

Feb. 9, 2006 (FR) ..... 06 01162

(51) Int. Cl.
*G01C 15/02* (2006.01)

(52) U.S. Cl. ..... 33/10; 33/1 Q

(58) Field of Classification Search ..... 33/10, 33/1 Q, 1 G, 1 CC
See application file for complete search history.

(56) References Cited

U.S. PATENT DOCUMENTS 6,311,624 B1 * 11/2001 Theurer et al. ..... 33/287
6,505,406 B2 1/2003 Robertson et al.
7,181,851 B2 * 2/2007 Theurer et al. ..... 33/1 Q
2007/0039510 A1 * 2/2007 Claas et al. ..... 104/2

FOREIGN PATENT DOCUMENTS

EP 0 803 609 A2 10/1997
EP 1 178 153 A1 2/2002

* cited by examiner

*Primary Examiner*—Yaritza Guadalupe-McCall
(74) *Attorney, Agent, or Firm*—Davidson, Davidson & Kappel, LLC

(57) ABSTRACT

A device for inserting elements into the ground in order to carry out works includes a positioning mechanism. The positioning mechanism includes an upper panel which is fixed to the chassis of a vehicle for transporting the insertion device, a movable plate to which an insertion arm is fixed, and at least six jacks which can be controlled so as to allow movement of the movable plate relative to the upper panel with six degrees of freedom, each jack being directly fixed, at one side, to the upper panel and, at the other side, to the movable plate of using connections which have three degrees of freedom in terms of rotation.

9 Claims, 3 Drawing Sheets

DEVICE AND METHOD FOR INSERTING ELEMENTS INTO THE GROUND, MECHANISM FOR THIS DEVICE AND SYSTEM USING THIS DEVICE

This claims priority to the French application number 06 01162, filed Feb. 9, 2006, and hereby incorporated by reference herein.

TECHNICAL FIELD

The present invention relates to a device and a method for inserting elements into the ground, a mechanism for this device and a system using this device.

BACKGROUND TO THE INVENTION

There are devices for inserting elements into the ground which comprise:

an insertion arm which is capable of pressing the elements into the ground in accordance with a predetermined pressing direction, and a mechanism for positioning the insertion arm relative to the ground which is capable of moving the insertion arm relative to the ground with at least six degrees of freedom, along and about three mutually orthogonal axes (X, Y, Z) of a three-dimensional reference system.

The insertion devices are used in particular for inserting into the ground elements for carrying out works. For example, these devices are used in order to insert sole plates into concrete slabs in order to support the rails of a rail track. In particular, this is used when rail tracks are constructed with no ballast or with no cross-member. For example, insertion devices of this type are described in the patent applications EP 0 803 609 and EP 1 178 153.

The insertion arm must be arranged above the ground with a high degree of precision. To this end, it is known to control the movement of the arm in accordance with geographical measurements (see EP 1 178 153).

These devices are satisfactory. However, it is desirable for the precision of the movement of the arm relative to the ground to be further improved.

The invention is intended to satisfy this wish by providing an insertion device in which the arm can be moved with a higher degree of precision.

SUMMARY OF THE INVENTION

The invention provides a device for inserting elements into the ground in which the positioning mechanism comprises:

an upper panel which is fixed to the chassis of the vehicle for transporting the insertion device, a movable plate to which the insertion arm is fixed, and at least six jacks which can be controlled so as to allow movement of the movable plate relative to the upper panel with six degrees of freedom, each jack being directly fixed, at one side, to the upper panel and, at the other side, to the movable plate by means of connections which have three degrees of freedom in terms of rotation.

In the above device, given that each jack is directly fixed, at one side, to the upper panel and, at the other side, to the movable plate, the movement errors of each of the jacks are not cumulative so that the positioning of the insertion arm relative to the ground is more precise.

The embodiments of this device may comprise one or more of the following features:

the six jacks have extension directions which are not mutually co-linear;

the mechanism comprises only six jacks whose extension directions are not co-linear;

the insertion arm has only one degree of freedom in order to allow the elements to be pressed into the ground;

the insertion arm is capable of pressing rail track sole plates into the ground.

The embodiments of the device further have the following advantages:

the use of six jacks whose extension directions are not co-linear allows the rigidity of the positioning mechanism to be increased since a desired position of the insertion arm relative to the ground corresponds to a single combination of the paths of the jacks, using only six jacks allows the weight and the spatial requirement of the positioning mechanism to be reduced.

The invention also provides a system for inserting sole plates for the construction of a rail track. This system comprises:

the above insertion device for inserting sole plates into the ground, and a unit for controlling the path of the jacks of the insertion device in accordance with geographical measurements.

The embodiments of the insertion system may comprise the following feature:

a vehicle for transporting the insertion device, to which vehicle the insertion device is fixed without any degree of freedom.

The invention also provides a positioning mechanism which is capable of being used in the insertion device above.

Finally, the invention also provides a method for inserting elements into the ground in order to carry out works using the insertion device above. This method comprises:

a step for controlling the jacks of the positioning mechanism in order to move the insertion arm relative to the ground as far as a predetermined reference position, and a step for inserting the elements into the ground in order to carry out works when the arm is placed in the reference position.

BRIEF DESCRIPTION OF DRAWINGS

The invention will be better understood from a reading of the following description, given purely by way of non-limiting example and with reference to the drawings, in which.

DESCRIPTION OF PREFERRED EMBODIMENT

Figure 1:
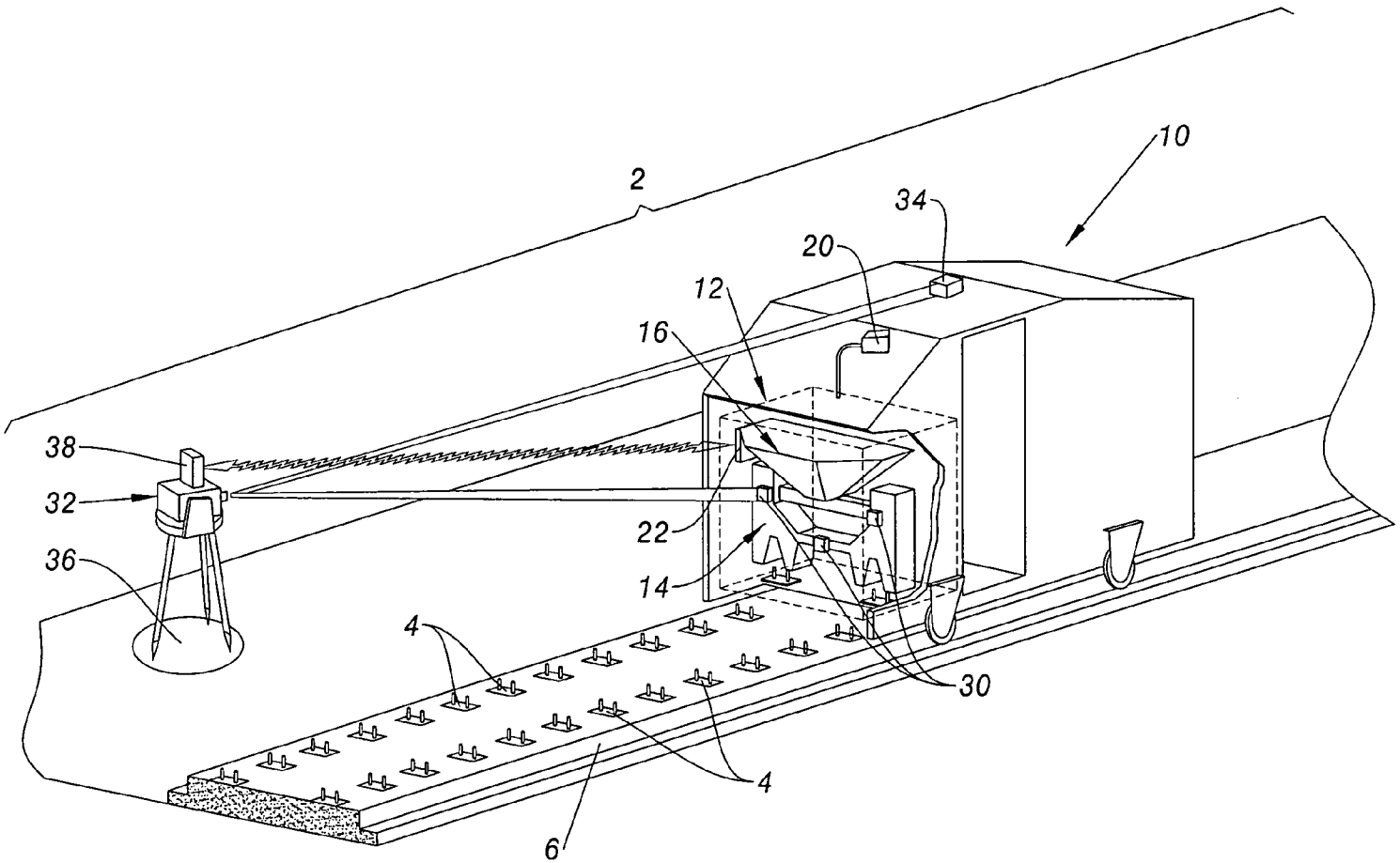
FIG. 1 is a perspective schematic illustration of a system for inserting sole plates for the construction of a rail track.

FIG. 1 illustrates a system 2 for inserting sole plates 4 into a concrete slab 6.

In the remainder of this description, the features and functions which are well known to the person skilled in the art are not described in detail.

The system 2 comprises a vehicle 10 for transporting a controllable device 12 for inserting sole plates 4.

The vehicle 10 is mounted on four steerable and/or driving wheels or tracks per axle, which allows independent movement of this vehicle in a specific direction. The vehicle 10 comprises a rear face to which the device 12 is fixed without any degree of freedom.

The device 12 comprises an arm 14 for inserting the sole plates and a controllable mechanism 16 for positioning the arm 14 relative to the upper surface of the concrete slab 6.

The vehicle 10 also comprises a control unit 20 which is capable of controlling the device 12 in accordance with geographical measurements received via a receiver 22. The geographical measurements are obtained based on measurements of the position of the arm 14 and/or the vehicle 10 relative to a topographical measurement post.

The unit 20 is also capable of controlling the movement of the vehicle 10.

The arm 14 comprises, on the rear face thereof, reflectors 30 which are capable of co-operating with a measuring station 32 which is installed at the edge of the rail track to be installed. For example, three reflectors 30 are fixed to the arm 14.

A reflector 34 is also fixed to the chassis of the vehicle 10. For example, this reflector 34 is mounted on the roof of the vehicle 10.

The station 32 is installed on a tripod perpendicular to a topographical measurement post 36. The geographical position of the post 36 in a frame of reference connected with the ground is known.

The station 32 comprises a laser type distance measuring device which is equipped with an optical transmitting unit and an optical receiving unit which allow the distance and the angle separating the station 32 from the assembly of reflectors 30 and 34 carried by the arm 14 and the vehicle 10, respectively, to be determined with a very high level of precision.

The station 32 is also provided with a radio transmitter 38 which sends the results of the measurements carried out at all times by the device 32 in the direction of the receiver 22 carried by the vehicle 10.

More details relating to the elements which allow the arm 14 to be moved to a reference position at which the sole plates must be inserted are given in the patent application EP 1 178 153.

Figure 2:
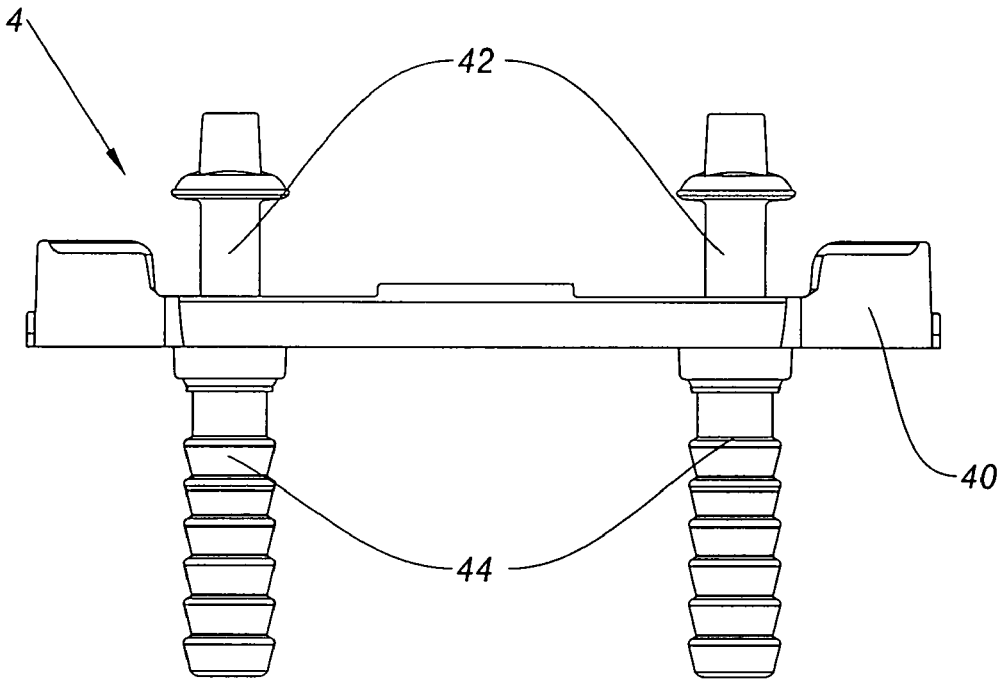
FIG. 2 is a schematic illustration of a sole plate which can be inserted using the system of FIG. 1.

FIG. 2 illustrates an example of a sole plate 2 which is intended to receive a rail and to transmit the force applied by a rail vehicle travelling on this rail to the slab 6.

To this end, the sole plate 4 comprises a plate 40 of rigid material and two anchors 42 which each have a threaded rod which allows a rail to be fixed to the sole plate 4 by means of nuts. The sole plate 4 also comprises two fixing rods 44 which are generally of cylindrical form and which ensure retention in the slab 6 after this slab has hardened.

Figure 3:
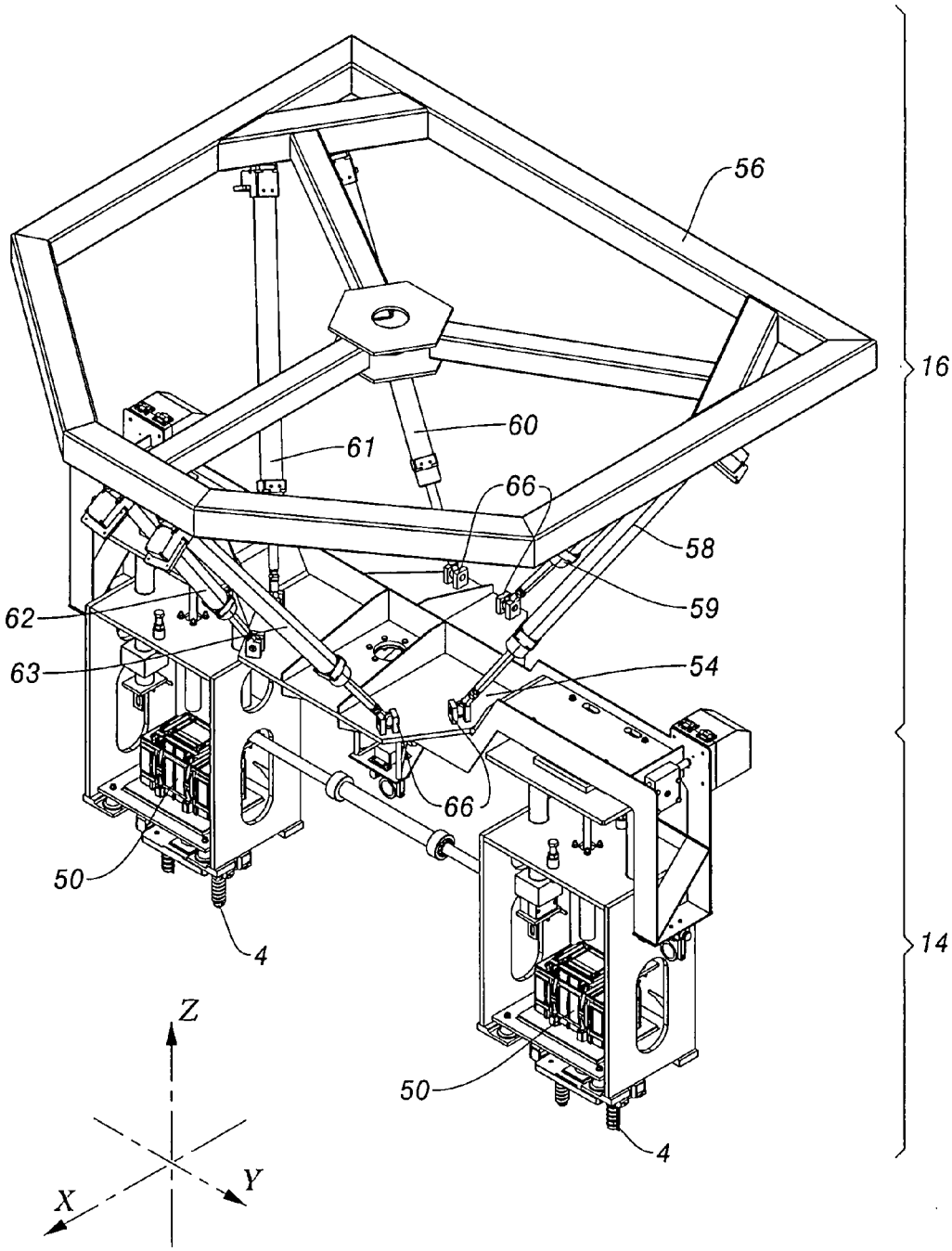
FIG. 3 is a perspective schematic illustration of a device for inserting sole plates used in the system of FIG. 1.

FIG. 3 illustrates the insertion device 12 in greater detail. In this Figure, the elements which have already been described with reference to FIG. 1 have the same reference numerals.

The arm 14 is capable of simultaneously inserting two sole plates 4 into the slab 6 when it has not yet hardened. To this end, the arm 14 is capable of implementing the insertion method described in the patent application EP 0 803 609 which involves vibrating the slab 6 which is still unset during the insertion of the sole plates.

For example, the arm 14 is generally in the form of an inverted U and supports, on the lower portion thereof, two jacks 50 to the ends of which two sole plates 4 are fixed which are intended to be inserted into the slab 6 which has been newly poured. The arm 14 is capable of maintaining the sole plates 4 at a distance from each other which corresponds to the gauge of the rail track to be installed. The arm 14 comprises only one degree of freedom which allows the sole plates 4 which are to be fixed to be displaced along an axis Z. The axis Z is defined in this instance as being perpendicular relative to the upper surface of the slab 6. An axis X which is parallel with the movement direction of the vehicle 10 and an axis Y which is perpendicular relative to the axes X and Z have also been illustrated in FIG. 3. These axes X, Y, Z form an orthogonal three-dimensional spatial reference system.

The arm 14 is, for example, described in greater detail in the patent application EP 0 803 609.

The mechanism 16 is capable of moving the arm 14 with six degrees of freedom, that is to say, three degrees of freedom in terms of rotation about the axes X, Y and Z and three degrees of freedom in terms of translation along the axes X, Y and Z.

To this end, the mechanism 16 is equipped:

with a movable plate 54, with an upper panel 56, and with six jacks 58 to 63 which are directly fixed, at one side, to the upper panel 56 and, at the other side, to the movable plate 54.

The arm 14 is fixed to a lower face of the plate 54 without any degree of freedom.

The panel 56 is fixed to the chassis of the vehicle 10 also without any degree of freedom.

Each jack 58 to 63 is fixed at each side, by means of a connection having three degrees of freedom in terms of rotation, to the plate 54 and the panel 56. The connection having three degrees of freedom in terms of rotation about the axes X, Y, Z is produced in this instance, for example, by means of a pivot joint 66. Each jack 58 to 63 can be controlled by the unit 20 so as to be extended or, conversely, retracted along an extension direction. In this instance, the six jacks 58 to 63 each have an extension direction which is not co-linear with that of the other jacks so as to be able to move the arm 14 with six degrees of freedom.

The jacks 58 to 63 are, for example, pneumatic, hydraulic or electric jacks. Any form of jack technology can be used to produce the jacks 58 to 63.

Figure 4:
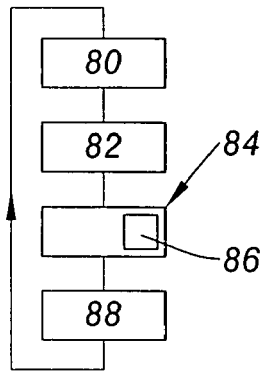
FIG. 4 is a flow chart of a method for inserting sole plates using the system of FIG. 1.

The operation of the system 2 and more precisely the device 12 will now be described with reference to the method of FIG. 4.

Initially, during a step 80, the geographical position of the arm 14 and the vehicle 10 is measured using the station 32. These geographical measurements are then transmitted, via the transmitter 38 and the receiver 22, to the control unit 20.

During a step 82, in response to these geographical measurements, and in accordance with pre-recorded coordinates of points at which the sole plates 4 must be inserted, the unit 20 controls the movement of the vehicle 10 in order to position the arm 14 at a reference position with a degree of precision in the order of one centimetre.

Then, during a step 84, the unit 20 precisely positions the arm 14 at the reference position at which the sole plates 4 must be inserted. During the step 84, the unit 20 controls, during an operation 86, the jacks 58 to 63 so as to arrange the arm 4 at the reference position thereof with a degree of precision to within less than a millimetre. To this end, the path of the jacks is calculated in accordance with the geographical measurements transmitted by the station 32 and the pre-recorded coordinates of the points at which the sole plates 4 must be inserted.

Once the arm 14 has been precisely positioned at the reference position, during a step 88, the arm 14 inserts the sole plates into the slab 6 of unset concrete.

After the step 88, the method returns to step 80 in order to insert the two following sole plates in the concrete slab 6.

A number of other embodiments are possible. For example, the insertion device described here for the specific case of inserting sole plates in order to support rail tracks can be adapted in order to insert any element which is necessary to carry out works.

The invention claimed is:

1. A device for inserting elements into the ground and capable of being fixed to a transport vehicle, the device comprising:

an insertion arm capable of pressing the elements into the ground with a predetermined pressing direction; and a mechanism for positioning the insertion arm relative to the ground capable of moving the insertion arm with at least six degrees of freedom, along three mutually orthogonal axes of a three-dimensional reference system, wherein, the positioning mechanism includes:

an upper panel fixed to a chassis of the vehicle for transporting the insertion device, a movable plate, the insertion arm being fixed to the moveable plate; and at least six jacks controllable to allow movement of the movable plate relative to the upper panel with six degrees of freedom, each jack being directly fixed in a rotational three degree of freedom manner, at one side, to the upper panel and, at the other side, to the movable plate.

2. The device as recited in claim 1 wherein the six jacks have extension directions not mutually co-linear.

3. The device as recited in claim 2 wherein the mechanism includes only six jacks whose extension directions are not co-linear.

4. The device as recited in claim 1 wherein the insertion arm has only one degree of freedom to allow the elements to be pressed into the ground.

5. The device as recited in claim 1 wherein the insertion arm is capable of pressing rail track sole plates into the ground.

6. A method for inserting elements into the ground using an insertion device as recited in claim 1 wherein the method comprises:

controlling the jacks of the positioning mechanism to move the insertion arm relative to the ground as far as a predetermined reference position, and inserting the elements into the ground when the arm is placed in the reference position.

7. A system for inserting sole plates for the construction of a rail track comprising:

a device for inserting the elements into the ground as recited in claim 1, the elements being sole plates; and a unit for controlling the path of the jacks of the insertion device in accordance with geographical measurements.

8. The system as recited in claim 7 further comprising the vehicle for transporting the insertion device, the insertion device being fixed to the vehicle without any degree of freedom.

9. A mechanism for positioning an insertion arm capable of being used in a device for inserting elements into the ground, the positioning mechanism comprising:

an upper panel fixed to a chassis of the vehicle for transporting the insertion device, a movable plate, the insertion arm being fixed to the moveable plate; and at least six jacks controllable to allow movement of the movable plate relative to the upper panel with six degrees of freedom, each jack being directly fixed in a rotational three degree of freedom manner, at one side, to the upper panel and, at the other side, to the movable plate.

* * * * *